US006742952B1

(12) United States Patent
Chen et al.

(10) Patent No.: US 6,742,952 B1
(45) Date of Patent: Jun. 1, 2004

(54) TRANSPARENT OR TRANSLUCENT TUBULAR STRUCTURE

(75) Inventors: Qingping Chen, Simpsonville, SC (US); Michael T. Nowak, Cheshire, CT (US)

(73) Assignee: BIC Corporation, Milford, CT (US)

( * ) Notice: Subject to any disclaimer, the term of this patent is extended or adjusted under 35 U.S.C. 154(b) by 0 days.

(21) Appl. No.: 10/375,049

(22) Filed: Feb. 28, 2003

(51) Int. Cl.[7] ..... B43K 5/12

(52) U.S. Cl. ..... 401/192; 401/222; 138/137; 138/DIG. 3

(58) Field of Search ..... 401/192, 195, 401/222, 141, 142; 138/137, 140, DIG. 3

(56) References Cited

U.S. PATENT DOCUMENTS

| | | | | |
|---|---|---|---|---|
| 3,618,614 A | * | 11/1971 | Flynn | 600/435 |
| 4,057,354 A | | 11/1977 | Bajusz et al. | |
| 4,198,739 A | | 4/1980 | Budinger et al. | |
| 4,430,288 A | | 2/1984 | Bonis | |
| 4,627,844 A | * | 12/1986 | Schmitt | 604/264 |
| 4,948,643 A | | 8/1990 | Mueller | |
| 4,994,047 A | | 2/1991 | Walker et al. | |
| 5,246,752 A | | 9/1993 | Raczkowski | |
| 5,270,086 A | | 12/1993 | Hamlin | |
| 5,425,817 A | | 6/1995 | Mugge et al. | |
| 5,429,849 A | | 7/1995 | Lasson et al. | |
| 5,439,454 A | * | 8/1995 | Lo et al. | 604/264 |
| 5,474,822 A | | 12/1995 | Rober et al. | |
| 5,500,263 A | | 3/1996 | Rober et al. | |
| 5,512,342 A | | 4/1996 | Rober et al. | |
| 5,529,820 A | | 6/1996 | Nomi et al. | |
| 5,554,425 A | | 9/1996 | Krause et al. | |
| 5,554,426 A | | 9/1996 | Rober et al. | |
| 5,626,930 A | | 5/1997 | Fukushi | |
| 5,639,409 A | | 6/1997 | van Muiden | |
| 5,655,847 A | | 8/1997 | Kobayashi et al. | |

(List continued on next page.)

FOREIGN PATENT DOCUMENTS

| | | |
|---|---|---|
| JP | 04-133732 A | 5/1992 |
| JP | 04-314539 A | 11/1992 |
| JP | 09-277776 A | 10/1997 |
| JP | 09-277777 A | 10/1997 |

*Primary Examiner*—David J. Walczak
(74) *Attorney, Agent, or Firm*—Jones Day

(57) ABSTRACT

A writing medium reservoir that exhibits clear drain of a writing medium, and preferably in which the writing medium is readily visible to the user. A method of making a writing medium reservoir that exhibits clear drain of a writing medium, and preferably in which the writing medium is readily visible to the user. The method may include forming the writing medium reservoir by co-extruding an inner layer and an outer layer. In addition, the present invention relates to a multi-layer tubular structure that exhibits clear drain of a liquid, and preferably in which the relative presence or relative absence of liquid is readily visible to the user.

36 Claims, 1 Drawing Sheet

U.S. PATENT DOCUMENTS 5,685,344 A 11/1997 Iorio et al.
5,733,400 A 3/1998 Gore et al.
5,733,619 A 3/1998 Patel et al.
5,789,047 A 8/1998 Sasaki et al.
5,803,130 A 9/1998 Robben et al.
5,899,618 A 5/1999 Kobayashi et al.
5,909,975 A 6/1999 Kobayashi
5,922,425 A 7/1999 Greuel
5,929,135 A 7/1999 Wasai et al.
5,931,201 A 8/1999 Hsieh
5,937,911 A 8/1999 Kodama et al.
5,958,532 A 9/1999 Krause et al.
6,024,133 A 2/2000 Kodama et al.
6,030,371 A 2/2000 Pursley
6,045,547 A 4/2000 Ren et al.
6,074,719 A 6/2000 Fukushi et al.
6,089,277 A 7/2000 Kodama et al.
6,117,508 A 9/2000 Parsonage et al.
6,136,394 A 10/2000 Karsten
6,149,997 A 11/2000 Patel et al.
6,177,518 B1 1/2001 Lahijani
6,197,393 B1 3/2001 Jing et al.
6,200,053 B1 * 3/2001 Asami et al. ..... 401/142
6,203,228 B1 3/2001 Schweizer
6,203,873 B1 3/2001 Shifman et al.
6,261,019 B1 7/2001 Furukawa
6,287,285 B1 9/2001 Michal et al.
6,293,312 B1 9/2001 Stripe
6,302,151 B1 10/2001 Maitay et al.
6,361,234 B1 * 3/2002 Rukan et al. ..... 401/180
6,398,441 B1 6/2002 Takayanagi
6,409,408 B2 6/2002 Koyama
6,503,965 B1 1/2003 Nowak et al.
2001/0019751 A1 9/2001 Ferrera et al.
2001/0021429 A1 9/2001 Nizuka et al.

* cited by examiner

TRANSPARENT OR TRANSLUCENT TUBULAR STRUCTURE

FIELD OF THE INVENTION

The present invention relates generally to a writing medium reservoir, and a writing instrument containing same, in which the writing medium is readily visible to the user, and which also advantageously exhibits substantially clear drain of the writing medium through the reservoir to the writing tip. The present invention also relates to a method of making such a writing medium reservoir, and a writing instrument containing same. In addition, the present invention relates to a multi-layer tubular structure, as well as a method of making same, in which the liquid medium therein is readily visible to the user and which tubular structure also advantageously exhibits substantially clear drain of the liquid medium through the tubular structure.

BACKGROUND OF THE INVENTION

A writing instrument contains a writing medium reservoir, e.g., an ink tube, charged with a selected amount of a writing medium, e.g., ink, which is depleted during the use of the writing instrument. Occasionally, the writing medium leaves a residue on the surface of the reservoir. It is desirable to reduce, if not to eliminate, the amount of such residue, so that as little writing medium as possible is left behind as residue (and thus wasted).

Additionally, it is often desirable to have a writing medium reservoir that is transparent or translucent so that the writing medium therein can be observed. It is also desirable to have as little residue as possible so that the view into the reservoir is substantially unobstructed and/or so that the content of writing medium in the reservoir can be readily determined. When the writing medium reservoir is transparent or translucent, a user can see the level of the writing medium within the reservoir.

If little or no residue remains on the interior surface of the writing medium reservoir as the writing medium level changes, then the writing medium reservoir is said to exhibit clear drain. As may be appreciated, clear drain is desirable in a transparent or translucent writing medium reservoir so that the user can accurately determine the amount of writing medium remaining in the reservoir.

When a material exhibits clear drain with respect to a liquid (regardless of its viscosity), such as a writing medium in this case, the material usually also exhibits anti-wetting properties with respect to that liquid, which typically means that the material has a significantly lower surface energy than that of the liquid. The difference in surface energies between the relatively solid material and the relatively liquid material (e.g., more formally, the difference between the surface tension of the writing medium and the surface energy of the material forming the interior surface of the reservoir) is manifested by the liquid preferring to associate with itself rather than with the material surface (e.g., by spreading out over the surface). Generally, but not necessarily universally, a material that exhibits anti-wetting properties with respect to a given liquid will also exhibit effective barrier properties against diffusion, sorption, or permeation of the given liquid into or through the material, e.g., against evaporation of the given liquid. Effective barrier properties of anti-wetting materials in writing medium reservoirs are especially desirable when the writing medium has a relatively volatile liquid base (e.g., such as water, acetone, butyl acetate, etc.), in order to prevent, control, or inhibit (hereinafter "control," without any intent to unduly limit) diffusive or permeative evaporation thereof through the reservoir.

While there are examples in the prior art of materials for use in writing medium reservoirs exhibiting anti-wetting properties or clear drain to some extent, none of these materials has been disclosed to be transparent or translucent materials. Transparent or translucent materials may have been independently disclosed for use in writing medium reservoirs, but the types of materials that can be easily fabricated into transparent or translucent parts are generally not the same types of materials that exhibit anti-wetting properties or clear drain with respect to typical writing media. While the material properties of transparency/translucency and clear drain are not diametrically opposed, the prior art has not successfully combined these properties in writing medium reservoirs.

In fact, only relatively recently has a polymeric fluorinated hydrocarbon material having a relatively low surface energy, which is normally fabricated as an opaque part, been fabricated as a thin sheet allegedly having transparent or translucent properties. Even so, significant effort and careful attention to fabrication parameters were required to attain the transparent or translucent properties in this thin sheet. Such a transparent material has not been suggested to be fabricated into a tubular shape, no less into a shape useful as a writing medium reservoir of a writing instrument.

SUMMARY OF THE INVENTION

One aspect of the present invention relates to tubular structures such as writing medium reservoirs exhibiting anti-wetting properties (e.g., at least partially exhibiting clear drain) with respect to a fluid such as a writing medium. Exemplary writing medium reservoirs formed in accordance with the principles of the present invention may be used in writing instruments including, but not limited to, ball point pens, rollerball pens, free ink pens, pens using gel ink, retractable tip pens, etc.

Clear drain is particularly beneficial in transparent or translucent writing medium reservoirs, so that the user can accurately observe the level of writing medium therein. However, even when a writing medium reservoir is not transparent or translucent, the anti-wetting properties of the writing medium reservoir are beneficial to reduce wastage of writing medium.

Anti-wetting properties can be measured, for example, by determining the difference between the surface tension of the fluid and the surface energy of the material forming the interior surface of the tubular structure. In cases where the surface tension of the fluid is equal to or less than the surface energy of the material forming the interior surface of the tubular structure (i.e., when the difference is a negative number), wetting of the tubular structure interior surface material with the fluid will usually occur. Even in certain cases where the surface tension of the fluid is slightly greater than the surface energy of the material forming the interior surface of the tubular structure (i.e., where the difference between those quantities is a relatively small positive number), there may still be sufficient wetting of the tubular structure interior surface by the fluid such that substantially clear drain is not exhibited. In cases where the surface tension of the fluid is more than slightly greater than the surface energy of the material forming the interior surface of the tubular structure (i.e., where the difference between those quantities is more than a relatively small positive number), the tubular structure interior surface generally has sufficient anti-wetting properties to exhibit substantially clear drain of the fluid. It is conceivable, however, in certain select cases where the surface tension of the fluid is significantly greater than the surface energy of the material forming the interior surface of the tubular structure (i.e., where the difference between those quantities is a relatively large positive number), that the fluid, instead of exhibiting substantially clear drain from the tubular structure interior surface, can have such strong molecular interactions with itself and can exhibit such non-wetting character with respect to the tubular structure interior surface material that it beads up on the tubular structure interior surface material and thus does not exhibit substantially clear drain properties.

In accordance with another aspect of the present invention, a writing medium reservoir may be formed from or may contain a material that is advantageously transparent or translucent (hereinafter "translucent," for simplicity and without any intent to limit). Such transparency or translucency (hereinafter "translucency," for simplicity and without any intent to limit) may be beneficial in conjunction with the above-described tubular structure that has anti-wetting properties, although the combination of both features is not required.

However, it is particularly beneficial to have a tubular structure such as a fluid reservoir or conduit that not only is translucent, but also exhibits clear drain. In accordance with the principles of the present invention, any translucent, and preferably optically transparent, writing medium reservoir, made of any desired material may be provided with an inner layer of a translucent, and also preferably optically transparent, relatively low surface energy polymer or copolymer to result in clear drain in a writing medium reservoir permitting external observation of the writing medium therein. In this manner, a wide range of materials may be used to form the writing medium reservoir, and only a small amount of relatively low surface energy polymer is necessary.

DETAILED DESCRIPTION OF THE PREFERRED EMBODIMENTS

Figure 1:
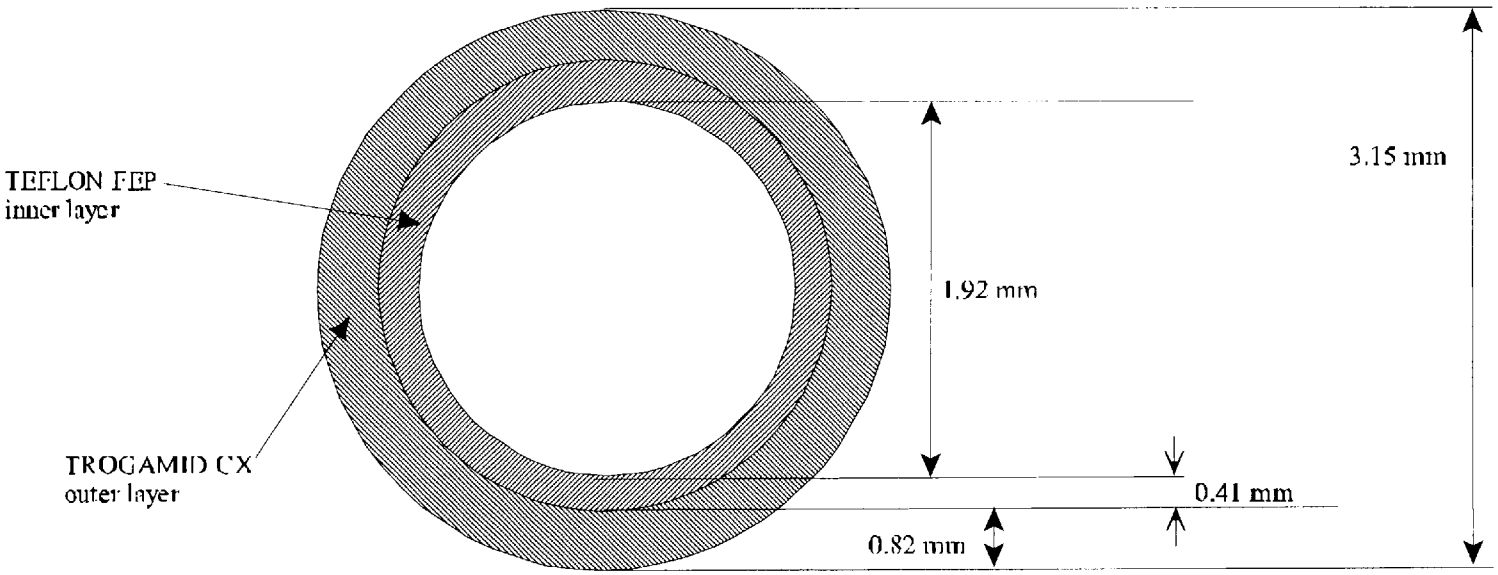
FIG. 1 shows a cross-section of a writing medium reservoir.

One aspect of the present invention relates to a translucent tubular structure, such as a reservoir or conduit that can hold or convey a fluid. A tubular structure particularly benefiting from the principles of the present invention is a writing medium reservoir, discussed in detail herein for the sake of convenience, and exemplary discussion. It will thus be appreciated that writing medium is referenced herein, for the sake of convenience as well, without intent to limit, as reservoirs and tubular structures other than writing medium reservoirs may be used with fluids other than writing media. Another aspect of the present invention relates to a writing instrument including the writing medium reservoir formed in accordance with the principles of the present invention. Examples of the types of writing instruments in which the principles of the present invention may be applied include, but are not limited to, ball point pens, rollerball pens, free ink pens, felt-tip pens, markers, highlighters, and the like. In one embodiment, the writing instrument may not include ink-jet printers. In another embodiment, the writing instrument is a hand-held writing instrument. In another embodiment, the writing instrument is finger-manipulable (i.e., sized, shaped, dimensioned, configured, and weighted to be manipulable by a person's fingers). It will also be appreciated that writing medium reservoirs are referenced herein regardless of the nature of the writing medium contained therein and without any intent to unduly limit to a particular writing medium or element in which such writing medium is contained.

The writing medium reservoir is preferably sufficiently translucent that a user can externally visually observe the level of the writing medium in the writing medium reservoir. This external visual observation of the writing medium level may be desired over the full length of the writing medium reservoir or over only a portion of the writing medium reservoir. As such, at least the portion of the writing medium reservoir over which external visual observation is desired preferably is translucent. In one embodiment, only the portion of the writing medium reservoir over which external visual observation is desired may be translucent. In another embodiment, more than the portion of the writing medium reservoir over which external visual observation is desired can be translucent as well.

Ideally, the writing medium reservoir can be made from a material or a combination of materials that provide the most clarity in visualization of the writing medium contained therein, and thus is essentially transparent, regardless of the nature of, color of, or contrast with the writing medium. However, it is sufficient that the writing medium reservoir can have a translucency such that a typical user is able to observe visually the level of the writing medium in the writing medium reservoir from the outside of the writing medium reservoir under normal conditions.

Another aspect of the present invention relates to an writing medium reservoir that exhibits substantially clear drain with respect to the writing medium. As used herein, the term "substantially" may refer to more than about 95%, preferably more than about 98%, more preferably more than about 99%, most preferably more than about 99.5%. Therefore, the phrases "substantially no," "substantially none," and "substantially not," as used herein, may refer to less than about 5%, preferably less than about 2%, more preferably less than about 1%, most preferably less than about 0.5%. Where applicable, all percentages expressed herein should be understood to be by weight, unless otherwise specified.

It will be appreciated that these two aspects of the invention are complementary and thus are particularly beneficial when combined together within the same writing medium reservoir. As will also be appreciated, the present invention typically is provided in a writing instrument body or barrel (hereinafter "barrel" for simplicity and without any intent to limit). Thus the present invention also relates to a writing instrument with a writing medium reservoir formed in accordance with the principles of the present invention. As described below, the writing medium reservoir is particularly useful in a transparent or at least translucent writing instrument barrel.

The translucency of the writing medium reservoir (or any other part of the writing instrument) can advantageously be measured in terms of a percent transmission through the material(s), e.g., according to ASTM D 1003. Preferably, in this embodiment, the writing medium reservoir (and optionally of any writing instrument component disposed over the writing medium reservoir, together or individually) exhibits at least about a 60% transmittance, more preferably at least about an 80% transmittance, most preferably at least a 90% transmittance, based on the ASTM D 1003 test.

The present invention generally pertains to a writing medium reservoir for holding writing medium in a free state, rather than in a fibrous wad. In one embodiment, the writing medium may be held directly in the barrel in a free state, in which case the barrel can additionally function as the writing medium reservoir. Alternatively, the writing medium may be held in a cartridge (e.g., a tube for ballpoint, rollerball, gel, or other type of writing medium), and a barrel may be inserted over or may receive the cartridge. Free ink writing instruments generally include a reservoir in which writing medium of a particular viscosity is contained in a "free state," as opposed to writing instruments in which a writing medium is held within a porous or fibrous material that serves as the writing medium reservoir. An ink transfer member, which includes a component or assembly of components, may be provided to transfer the writing medium from the writing medium reservoir to, and sometimes through, the writing tip for application of the writing medium onto a writing substrate (i.e., normal use).

The writing medium reservoir in writing instruments according to the invention may optionally be present as a part of a removable cartridge. This removable cartridge may include only the writing medium reservoir or additionally one or more other elements or components which can contact the writing medium (e.g., the element(s) of the writing tip, and optionally the ink storage area, if present) such that the entire set of elements or components that constitute the desired flow path of the writing medium from writing medium reservoir to writing tip are contained in the replaceable cartridge. When the cartridge containing the writing medium is removable and the ink reservoir portion of the removable cartridge extends for substantially the length of the body or barrel, the removable cartridge may alternately be called an ink tube, with no intent to limit the size, shape, configuration, dimensions, or any other aspect of the removable cartridge.

With regard to the clear-draining quality of the writing medium reservoir, the interior surface of the writing medium reservoir (i.e., the surface of the writing medium reservoir that is contacted by the writing medium) should have sufficient anti-wetting properties with respect to the writing medium contained therein so that as the writing medium is used substantially no writing medium remains on the interior surface of the writing medium reservoir (e.g., as a coating or a partial coating) where it previously contacted the interior surface of the writing medium reservoir before use, i.e., the writing medium reservoir exhibits substantially clear drain properties. One skilled in the art should appreciate that the clear-draining quality of the writing medium reservoir preferably does not substantially change over time.

The anti-wetting properties and/or the propensity of a material for exhibiting clear drain with respect to a particular writing medium can be measured, for example, by assessing the difference between the surface tension of the writing medium and the surface energy of the material forming the interior surface of the reservoir. In one embodiment, the difference between the surface tension of the writing medium and the surface energy of the material forming the interior surface of the writing medium reservoir is a positive number. In another embodiment, the difference between the surface tension of the writing medium and the surface energy of the material forming the interior surface of the writing medium reservoir is such that substantially no writing medium residue remains on the material forming the interior surface. In still another embodiment, the difference between the surface tension of the writing medium and the surface energy of the material forming the interior surface of the writing medium reservoir is at least about the critical surface energy difference. As used herein, the "critical surface energy difference," or CSED, represents the lowest value of the difference between the surface tension of the writing medium and the surface energy of the material forming the interior surface of the reservoir at which substantially clear drain is exhibited. In yet another embodiment, the difference between the surface tension of the writing medium and the surface energy of the material forming the interior surface of the writing medium reservoir is not so significant, or so large a positive number, such that the writing medium at least partially coats or tends to bead up on the writing medium reservoir interior surface material, e.g., such that the interior surface material of the reservoir does not exhibit substantially clear drain.

In another embodiment, the difference between the surface tension of the writing medium and the surface energy of the material forming the interior surface of the writing medium reservoir is at least about 3 dynes/cm (i.e., 3 mN/m). In a preferred embodiment, the difference between the surface tension of the writing medium and the surface energy of the material forming the interior surface of the writing medium reservoir is at least about 5 dynes/cm (i.e., 5 mN/m). In another preferred embodiment, the difference between the surface tension of the writing medium and the surface energy of the material forming the interior surface of the writing medium reservoir is at least about 7 dynes/cm (i.e., 7 mN/m). In another preferred embodiment, the difference between the surface tension of the writing medium and the surface energy of the material forming the interior surface of the writing medium reservoir is at least about 10 dynes/cm (i.e., 10 mN/m). In another embodiment, the difference between the surface tension of the writing medium and the surface energy of the material forming the interior surface of the writing medium reservoir is not more than about 50 dynes/cm (i.e., 50 mN/m), alternately not more than about 35 dynes/cm (i.e., 35 mN/m), alternately not more than about 25 dynes/cm (i.e., 25 mN/m).

As it is typically only the very surface of the interior of the writing medium reservoir that contacts the writing medium and typically not the entire thickness of the writing medium reservoir, it may be desirable that a writing medium reservoir according to the invention include an inner layer material (e.g., defining the interior surface of the writing medium reservoir) to provide properties such as anti-wetting, and optionally permeation/diffusion/sorption resistance, with respect to the writing medium, which inner layer material may also advantageously be translucent, and at least one other layer of material, e.g., an outer layer material, disposed over the inner layer material, which outer layer material may also advantageously be translucent. In the case where it is desired that at least a portion of the writing medium reservoir be translucent, the translucency of the inner layer material and of the outer layer material should preferably be such that, when combined in a writing medium reservoir according to the invention, the resultant reservoir exhibits sufficient translucency to allow a user to observe visually, from outside the reservoir, the level of the writing medium in the reservoir.

It may be desirable to use different layers of materials in a writing medium reservoir according to the principles of the invention in order to obtain a combination (preferably a synergistic combination) of the desirable physical, chemical, and/or mechanical properties of each separate material. For example, when two different layers of materials are used in a writing medium reservoir, i.e., an inner layer and an outer layer, the desirable properties for the inner layer can include, but are not limited to: anti-wetting with respect to the writing medium; substantially clear drain with respect to the writing medium; barrier to or inhibitor of diffusion, permeation, or sorption of the writing medium; chemical inertness; chemical stability; mechanical stability; flexibility; transparency and/or translucency; chemical and/or mechanical compatibility with the outer layer material; or the like; or any combination thereof. In the same example, the desirable properties for the outer layer material can include, but are not limited to: barrier to or inhibitor of diffusion, permeation, or sorption of the writing medium; chemical inertness; chemical stability; mechanical stability; rigidity (e.g., at least enough to independently support the weight of the writing medium reservoir, and optionally any components, such as a point, a front nose cone, a point support, elements associated with a retractable writing tip, etc., that are integral with or attached to the writing medium reservoir, such that the outer layer material, at most, experiences elastic and not plastic deformation, or preferably such that the outer layer material does not exhibit significant mechanical deflection); transparency and/or translucency; chemical and/or mechanical compatibility with the inner layer material; or the like; or any combination thereof.

When a writing medium reservoir is utilized in a writing instrument (and even in certain cases involving another type of writing medium reservoir), the barrel, as well as any elements or components of the writing instrument that may be disposed over all or part of the writing medium reservoir, or at least those portions of the barrel and/or other writing instrument component(s) that are disposed over the writing medium reservoir, may be translucent. As above, the translucent quality of the portion of the writing instrument disposed over the writing medium reservoir should preferably be such that a user can visually observe the level of the writing medium in the writing medium reservoir externally. This external visual observation of the writing medium level may be desired over the full length of the barrel and/or other component(s) disposed over the writing medium reservoir, over only the portion of the barrel and/or other component(s) disposed over the writing medium reservoir that extend over the writing medium reservoir, or over only a segment of the portion of the barrel and/or other component(s) disposed over the writing medium reservoir that extend over the writing medium reservoir. As such, at least the portion of the barrel and/or other component(s) disposed over the writing medium reservoir over which external visual observation is desired may be translucent. However, the user can visually observe the level of the writing medium in the writing medium reservoir by removing a non-transparent, non-translucent barrel (and/or any other non-transparent, non-translucent components) over which the writing medium reservoir is disposed, in order to expose the writing medium reservoir. In one embodiment, only the portion of the barrel and/or other component(s) disposed over the writing medium reservoir over which external visual observation is desired may be translucent. In another embodiment, more than merely the portion of the barrel and/or other component (s) disposed over the writing medium reservoir over which external visual observation is desired can be translucent. In another embodiment, the barrel and/or other component(s) disposed over the writing medium reservoir over which external visual observation is desired may be both non-transparent and non-translucent.

Suitable inner layer materials can vary, based on the writing medium with which they are to come in contact. Exemplary inner layer materials include, but are not limited to, polymers or copolymers containing partially halogenated monomeric repeat units, polymers or copolymers containing substantially halogenated monomeric repeat units, polysiloxane homopolymers or copolymers, olefin homopolymers or copolymers, vinyl polymers or copolymers, homopolymers or copolymers containing an amide group, or any combination thereof. In one preferred embodiment, the inner layer material includes polymers or copolymers containing at least partially halogenated monomeric repeat units, preferably polymers or copolymers containing substantially halogenated monomeric repeat units. In another preferred embodiment, the halogen is fluorine; i.e., the inner layer material includes polymers or copolymers containing at least partially fluorinated monomeric repeat units, preferably polymers or copolymers containing substantially fluorinated monomeric repeat units. More preferably, the inner layer material includes polymers or copolymers consisting of at least partially fluorinated monomeric repeat units, most preferably polymers or copolymers consisting of substantially fluorinated monomeric repeat units. In any of these embodiments, the substantially fluorinated monomeric repeat unit may include, but are not limited to, tetrafluoroethylene, hexafluoropropylene, perfluorinated acrylates, perfluorodioxoles, perfluoroalkoxy monomeric repeat units, and the like, and combinations and copolymers thereof. Examples of polymers or copolymers consisting essentially of substantially fluorinated monomeric repeat units include, but are not limited to, fluorinated ethylene-propylene, such as commercially available under the tradenames TEFLON FEP from DuPont Chemical of Wilmington, Del., NEOFLON FEP from Daikin America of Decatur, Ala., and HOSTAFLON FEP from Hoechst Celanese in Texas; tetrafluoroethylene-perfluorodioxole copolymers, such as commercially available under the tradename TEFLON AF from DuPont Chemical of Wilmington, Del.; and perfluoroalkoxy fluorocarbon resins, such as commercially available under the tradename TEFLON PFA from DuPont Chemical of Wilmington, Del., NEOFLON perfluoroalkoxy fluorocarbon resin from Daikin America of Decatur, Ala., HOSTAFLON perfluoroalkoxy fluorocarbon resin from Hoechst Celanese in TX, and HYFLON from Ausimont USA, Inc., of Thorofare, N.J. For example, a copolymer consisting essentially of at least partially fluorinated monomeric repeat units can include, but is not limited to, a copolymer of a substantially fluorinated monomeric repeat unit with a non-fluorinated monomeric repeat unit (e.g., an alpha-olefin, such as ethylene, propylene, or the like, or a combination thereof).

Exemplary outer layer materials may include, but are not limited to, cellulosic polymers, polyketones, polyesters or polyester glycols (e.g., poly(ethylene terephthalate)s and/or PETG), poly(vinyl chloride), styrene-containing copolymers (e.g., SBS triblock copolymers, SB diblock or multiblock copolymers, styrene-acrylonitrile copolymers, such as ABS, and the like, and combinations thereof), polymers containing acrylate groups, poly(vinyl acetate)s, polycarbonates, polyamides (e.g., transparent nylons, such as those sold under the tradename TROGAMID CX from Degussa AG of Frankfurt, Germany), polyolefins (e.g., polyethylenes, such as HDPE, LDPE, LLDPE, UHMWPE, and the like; polypropylenes; and the like; and combinations thereof), polymers or copolymers containing partially halogenated monomeric repeat units, polymers or copolymers containing substantially halogenated monomeric repeat units, and mixtures, blends, or copolymers thereof.

For example, a cellulosic polymer according to the invention can include, but is not limited to, native or synthetic cellulose, cotton, regenerated cellulose (e.g., rayon, cellophane, or the like), cellulose acetate, cellulose propionate, cellulose butyrate, cellulose acetate-propionate, cellulose acetate-butyrate, cellulose propionate-butyrate, cellulose nitrate, methyl cellulose, ethyl cellulose, carboxymethyl cellulose, carboxyethyl cellulose, cellulose salts, and combinations or copolymers thereof. A cellulosic polymer according to the invention may be present as naturally extracted, as synthesized, or as modified or processed in some way, e.g., partially or fully esterified, partially or fully nitrated, partially or fully regenerated, partially or fully etherified, partially or fully acidified, partially or fully acid-neutralized, or the like, or combinations thereof.

Depending on the chemical and physical nature of the materials used for the inner and outer layers of the writing medium reservoir, there may be an issue of compatibility between the inner and outer layer materials. In one embodiment, the inner layer material and outer layer material are sufficiently compatible with each other, and/or are formed in such a way or by such a method, so that they are preferably substantially fixed relative to each other, and optionally adhered to each other, at the interface between the layers. For instance, this compatibility may be chemical or mechanical in nature, and preferably the level of compatibility necessary need only be such that normal handling and normal use of the writing medium reservoir, or of a writing instrument containing same, by a user does not substantially affect the translucency, the substantially clear drain capability, and/or the further normal function of the writing medium reservoir.

If the compatibility of the inner and outer layer materials is insufficient, for example, delamination at the interface of the layers may occur. Delamination, in and of itself, is not necessarily a problem. However, where delamination may occur, it is preferable that the delamination does not cause significant changes in opacity (where translucency is desired) to such an extent as to render the writing medium reservoir no longer sufficiently translucent. Furthermore, where delamination may occur, it is preferable that the delamination does not cause significant structural changes in the writing medium reservoir to such an extent as to curtail significantly flow of the writing medium out from the writing medium reservoir or to reduce significantly the level of clear drain exhibited (where the property of clear drain with respect to the writing medium is desired).

In order to establish sufficient compatibility between the inner and outer layer materials of the writing medium reservoir, generally where such compatibility would otherwise be insufficient according to the invention, an intermediate layer such as a compatibilizing layer may be inserted between the inner and outer layers. For instance, the intermediate layer may include an additional layer of material, which may include, but is not limited to, an adhesive, a copolymer containing at least one monomeric repeat unit present in each of the inner and outer layer materials, a copolymer containing at least one monomeric repeat unit that is chemically similar enough to at least one monomeric repeat unit present in each of the inner and outer layer materials to render the inner and outer layer materials sufficiently compatible, or the like, or a combination thereof. When translucency is desired, the translucency of the intermediate layer material should preferably be such that, when combined with the inner layer material and the outer layer material in a writing medium reservoir according to the invention, the resultant writing medium reservoir exhibits sufficient translucency to allow a user to observe visually the level of the writing medium in the writing medium reservoir from outside the reservoir.

In one embodiment, the outer layer material may be compatibilized with the inner layer material by adding an intermediate layer that is a blend of polymers containing at least one monomeric repeat unit present in each of the inner and outer layer materials, respectively, or containing at least one monomeric repeat unit that is chemically similar enough to at least one monomeric repeat unit present in each of the inner and outer layer materials, respectively, to render the inner and outer layer materials sufficiently compatible. In another embodiment, for increased compatibilization, a similar blend of materials may additionally or alternately be provided in the outer layer material, preferably provided that at least one component material of the blend can preferentially be present at the interface with the inner layer material in an amount sufficient to provide sufficient compatibility with the inner layer material. In these embodiments, the blend of materials itself should also be sufficiently translucent to allow a user to observe visually the level of the writing medium in the writing medium reservoir from outside the reservoir.

Alternately, the compatibilizing intermediate layer may include treating the interior surface of the outer layer material or the outer surface of the inner layer material (or both) to alter (e.g., chemically or mechanically) that surface (or those surfaces) at the inner layer-outer layer interface to create sufficient compatibility. This treatment may advantageously include adding material, removing material, changing the physical arrangement of material, or altering the chemical nature of material, specifically at the inner-outer layer interface. For instance, treating the surface(s) may include, but is not limited to, using reactive wet chemical techniques (e.g., solution chemistry) to functionalize the surface(s) to form a functionalized layer that renders the inner and outer layer materials sufficiently compatible; using reactive non-wet chemical techniques (e.g., high-energy radiation such as UV light, microwaves, or gamma- or x-rays; reactive gas plasmas such as nitrogen, oxygen, or halogen gases; noble gas plasmas such as argon; subatomic particle bombardment such as with electrons or beta-particles; or combinations thereof) to functionalize the surface(s) to form a functionalized layer that renders the inner and outer layer materials sufficiently compatible; chemically, physically, or mechanically flattening the surface(s), e.g., by ablating or otherwise removing a portion of the material from the surface(s), such as with a laser, by redistributing the material at the surface(s), so that the surface area available for intimate contact (e.g., through van der Waals interactions) is sufficient to render the inner and outer layer materials sufficiently compatible, by introducing a liquid (e.g., a viscous liquid) that sufficiently wets at least one (and preferably both) of the surfaces in an amount sufficient to level out the surface(s) and/or to increase the surface area available for intimate contact (e.g., through van der Waals interactions) to such an extent as to render the inner and outer layer materials sufficiently compatible, by adjusting one or more processing and/or fabrication parameters, including but not limited to, processing speeds, processing temperatures and/or temperature gradients, processing residence times, fabrication die profiles, processing additives, cooling rate for at least partially fabricated portions, post-fabrication treatment, and the like (e.g., any parameters that would commonly be optimized in processing methods, such as extrusion, co-extrusion, injection molding, and the like, that would be used to form the multi-layer piece according to the present invention), and combinations thereof, or the like, or a combination thereof. Preferably, any treatment of the interior surface of the outer layer material and/or the exterior surface of the interior layer material will not substantially reduce the translucency of the inner layer material, the outer layer material, or preferably both.

In most cases, materials that provide anti-wetting surfaces to writing media are generally not sufficiently translucent such that a user can visually observe externally the level of writing medium through such materials. Preferably, the thickness of the inner layer material is at least enough to provide anti-wetting surface properties when the interior surface of the writing medium reservoir is contacted with a writing medium. However, although materials that are anti-wetting for writing media and that are sufficiently translucent are contemplated as materials comprising the interior surface of writing medium reservoirs according to the invention, usually only by making the anti-wetting material relatively very thin can they be rendered sufficiently translucent such that a user can visually observe externally the level of writing medium through such anti-wetting material. In addition, as the anti-wetting material is usually more expensive than traditional, not substantially clear drain, transparent materials, the use of a relatively very thin inner layer material may provide a significant cost benefit over forming the entire writing medium reservoir out of the anti-wetting material. In alternate preferred embodiments, the thickness of the inner layer material may be at least about 10 microns, at least about 50 microns, at least about 100 microns, or at least about 250 microns. In another embodiment, the thickness of the inner layer material is not more than about 3 mm, preferably not more than about 2 mm, alternately not more than about 1 mm, for example not more than about 700 microns.

The outer layer material, optionally in addition to possessing sufficient translucency, may advantageously be thick and rigid enough to support the weight of the entire writing medium reservoir. Optionally, particularly in the form of a writing medium reservoir, the outer layer is also thick enough to be substantially inflexible under conditions of normal use according to the invention. One exemplary reason for structural stability of the outer layer material is that a certain level of rigidity is typically desired in the writing medium reservoir according to the invention. Nevertheless, the inner layer material (optionally, as well as the intermediate compatibilizing layer material, if present) is generally of such a thickness (combined, where applicable), of such a molecular weight, and/or of such a chemical composition so as to impart little, if any, structural support to the writing medium reservoir. Thus, the outer layer typically should provide sufficient structural stability to substantially support the inner layer.

Structural stability of the outer layer material may be quantified in a number of different ways. For example, tensile modulus, flexural modulus, tensile strength, and/or strain-at-break (e.g., percent elongation), e.g., as determined by ASTM D638/D412, D790, D638/D412, and D638/D412, respectively, can sometimes be used to distinguish rigid materials from flexible ones. In one embodiment, the outer layer material can exhibit a tensile modulus of at least about 1400 psi, alternately at least about 3500 psi, or at least about 5000 psi. In another embodiment, the outer layer material can exhibit a flexural modulus of at least about $1\times10^5$ psi, alternately at least about $3\times10^5$ psi, or at least about $5\times10^5$ psi. In still another embodiment, the outer layer material can exhibit a tensile strength of at least about 2000 psi, alternately at least about 4500 psi, or at least about 7000 psi. In yet another embodiment, the outer layer material can exhibit a percent elongation of no more than about 100%, alternately no more than about 40%, or no more than about 10%.

In a preferred embodiment, the substantially clear draining writing medium reservoir may be formed by co-extruding an inner layer material and an outer layer material. The inner and/or outer layer materials can be, individually and when combined, sufficiently translucent such that a user can readily observe visually the level of the writing medium in the writing medium reservoir from outside the reservoir. In this embodiment, the inner layer material (i.e., the surface of the writing medium reservoir that contacts the writing medium) should have sufficient anti-wetting properties with respect to the writing medium contained therein so that, as the writing medium is used, substantially no writing medium remains as residue (e.g., in the form of a coating or partial coating) on the interior surface of the writing medium reservoir where it previously contacted the inner layer material before the writing medium was used (e.g., the writing medium reservoir exhibits substantially clear drain).

In another embodiment, the clear drain capability of a writing medium reservoir, as well as of a writing instrument containing same, may be increased by introducing an inner layer material disposed under or within the material defining the boundary of the writing medium reservoir, which materials can advantageously be, individually and when combined, sufficiently translucent such that a user can externally visually observe the level of the writing medium in the writing medium reservoir. Advantageously, the inner layer material can be introduced by being co-extruded with the outer layer that defines the writing medium reservoir boundary. In one embodiment, when compatibility of the inner and outer layer materials is an issue, the writing medium reservoir may be formed by co-extrusion of an intermediate or compatibilizing layer between the inner and outer layer materials. Alternately or additionally, the interior surface of the material defining the boundary of the writing medium reservoir may be treated so that sufficient compatibility with the inner layer material may result.

In another aspect of the invention, a multi-layer tubular structure("multi-layer tube" for the sake of simplicity and without intent to limit) can be formed from at least an inner layer of polymeric material and an outer layer of polymeric material, as described above. The multi-layer tube according to the invention may be used to hold or to transport any of a number of liquids (e.g., over any range of viscosities, whether high, low, or intermediate), not just writing medium, e.g., organic solvents, water, aqueous solutions, organic solutions, liquid chemicals or chemical mixtures, or the like. In one embodiment, the liquid can contain an ink, such as those disclosed in U.S. Pat. Nos. 6,503,965 and 6,425,948, and U.S. patent application Ser. Nos. 09/645,284 and 09/900,914, the entire disclosures of which are hereby incorporated by reference in their entirety. In another embodiment, the liquid can contain biological material (e.g., in solution) or can be used in an in vivo biological environment (e.g., blood, plasma, saline, or the like). As above, the inner and outer layer materials, together in the multi-layer tube according to the invention, are preferably sufficiently translucent such that the liquid contained therein can be externally visually observed. Also, as above, the inner layer material preferably has sufficient anti-wetting properties with respect to the liquid contained therein so that, as the liquid passes therethrough, substantially no liquid remains as a coating or partial coating on the interior surface of the tube where the liquid previously contacted the interior surface of the tube.

In a preferred embodiment, the inner layer material acts substantially as a barrier against diffusion, sorption, and/or permeation of the contacting liquid into and/or through the inner layer. In another embodiment, the inner layer polymeric material includes, but is not limited to, polymers or copolymers containing at least partially halogenated monomeric repeat units, such as polymers or copolymers containing substantially halogenated monomeric repeat units, alternately polymers or copolymers consisting essentially of at least partially halogenated monomeric repeat units, such as polymers or copolymers consisting essentially of substantially halogenated monomeric repeat units. In another embodiment, the halogen is fluorine.

The outer layer material of the multi-layer tube according to the invention may be relatively rigid, as in the writing medium reservoir according to the invention. One exemplary reason for rigidity in the outer layer material is that a certain level of structural stability is typically desired in the multi-layer tube according to the invention. Alternatively, and notwithstanding the foregoing descriptions with regard to writing medium reservoirs, the outer layer material of the multi-layer tube may be relatively flexible, so long as the inner layer material and outer layer material preferably exhibit sufficient compatibility with each other, or preferably are formed in such a way or by such a method to be preferably substantially fixed relative to each other, and optionally adhered to each other, at the interface between the layers, while also preferably maintaining translucency of the multi-layer tube. This compatibility may be chemical or mechanical in nature, and preferably the level of compatibility necessary need only be such that normal handling and normal use of the multi-layer tube, or of a device containing same, by a user does not substantially affect the translucency, the substantially clear drain capability, and/or the further normal function of the multi-layer tube.

For example, in biomedical applications, the outer layer material of a multi-layer tube according to the invention can generally be sufficiently resilient, rigid, and thick enough to be manipulable and mechanically stable under conditions of normal use, but not so rigid as to prevent flexing during normal use. The inner layer material (optionally, as well as the intermediate compatibilizing layer material, if present) is generally (though not necessarily) of such a thickness (or thicknesses combined, where applicable), of such a molecular weight, and/or of such a chemical composition so as to impart little, if any, structural support to the multi-layer tube according to the invention.

EXAMPLES

Exemplary embodiments of the present invention will be illustrated by reference to the following examples, which are included to exemplify, but not to limit, the scope of the present invention.

Example 1

Multi-Layer Writing Medium Reservoir, Removable Writing Instrument Cartridge, and Writing Instrument According to the Invention The writing medium reservoir of Example 1 was a hollow cylinder formed from an inner layer of TEFLON FEP and an outer layer of TROGAMID CX. As shown in FIG. 1, the cross-section of the writing medium reservoir had an outer diameter of about 3.15 mm and an inner diameter of about 1.92 mm. The outer layer was approximately 820 microns thick, while the inner layer thickness was approximately 410 microns.

In addition, the writing medium reservoir of Example 1 was substantially inflexible under its own weight and had an optical transmission of about 90%, as measured according to ASTM D 1003.

The writing medium reservoir of Example 1 was formed by co-extrusion of the inner and outer layer materials between about 80° C. to about 150° C. This operation was performed in a conventional co-extruder.

To the writing medium reservoir of Example 1 was added a writing tip including a point, a point support, and a front nose cone, such that the writing medium reservoir and the writing tip were integral. In addition, writing medium similar to the conventional solvent-based ink used in the VELOCITY® pen, commercially available from BIC Corporation of Milford, Conn., was placed into the writing medium reservoir. The particular writing tip used was similar to the conventional ball point tip used in the aforementioned VELOCITY® pen. Thus, a removable writing instrument cartridge according to the invention and containing the writing medium reservoir of Example 1 was made.

To the removable writing instrument cartridge was added a barrel and optionally an end plug, which was/were similar to that used in the aforementioned VELOCITY® pen. Thus, a writing instrument according to the invention and including the removable writing instrument cartridge, which contains the writing medium reservoir of Example 1 was made.

Example 2

Method of Co-Extruding a Writing Medium Reservoir According to the Invention

A writing medium reservoir according to the invention was formed by co-extrusion of an inner layer material and an outer layer material, in this case (as in Example 1) TEFLON FEP and TROGAMID CX, respectively, at a temperature between about 80 and about 150° C. This operation was performed in a conventional co-extruder.

Although the present invention is described with reference to certain preferred embodiments and drawings, it is apparent that modification and variations thereof may be made by those skilled in the art without departing from the spirit and scope of this invention as defined by the appended claims. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

What is claimed is:

1. A writing instrument cartridge comprising:

an inner layer comprising a first polymeric material having sufficient anti-wetting properties with respect to a writing medium such that said first polymeric material exhibits substantially clear drain of said writing medium;

an outer layer comprising a second polymeric material; and a writing tip coupled to one end of the writing medium reservoir, wherein:

said inner layer material and said outer layer material have a translucency such that, when combined, said writing medium reservoir exhibits sufficient translucency to allow a user externally to observe visually the level of said writing medium in said writing medium reservoir; and said inner layer material and said outer layer material are sufficiently compatible such that normal handling and normal use of said writing medium reservoir by said user does not substantially affect one or more of the following: said translucency, said substantially clear drain capability, and further normal function of said writing medium reservoir.

2. A writing instrument comprising:

an inner layer comprising a first polymeric material having sufficient anti-wetting properties with respect to a writing medium such that said first polymeric material exhibits substantially clear drain of the fluid;

an outer layer comprising a second polymeric material;

a writing tip coupled to one end of the tubular structure; and a barrel, at least a portion of which is sufficiently translucent to allow a user to externally visually observe the level of the fluid contained in said tubular structure;

wherein:

said inner layer material and said outer layer material have a translucency such that, when combined, said tubular structure exhibits sufficient translucency to allow a user externally to observe visually the level of the fluid in said tubular structure; and said inner layer material and said outer layer material are sufficiently compatible such that normal handling and normal use of said tubular structure by said user does not substantially affect one or more of the following: said translucency, said substantially clear drain capability, and further normal function of said tubular structure.

3. The writing instrument according to claim 2, wherein said inner layer material of said writing medium reservoir comprises a polymer or copolymer consisting essentially of substantially fluorinated repeat units.

4. The writing instrument according to claim 2, wherein said inner layer material comprises fluorinated ethylene-propylene and/or a perfluoroalkoxy polymer.

5. The writing instrument according to claim 2, wherein the thickness of said inner layer material is at least about 10 microns.

6. The writing instrument according to claim 2, wherein said barrel and said writing medium reservoir, when combined, exhibit an optical light transmittance under ASTM D1003 of at least about 80%.

7. The writing instrument according to claim 2, wherein the difference between the surface tension of a writing medium and the surface energy of the writing medium-contacting surface of said inner layer material of said writing medium reservoir is at least about 5 mN/m.

8. A tubular structure comprising:

an inner layer comprising a first polymeric material having sufficient anti-wetting properties with respect to a fluid such that said first polymeric material exhibits substantially clear drain of the fluid; and an outer layer comprising a second polymeric material;

wherein:

said inner layer material and said outer layer material have a translucency such that, when combined, said tubular structure exhibits sufficient translucency to allow a user externally to observe visually the level of the fluid in said tubular structure; and said inner layer material and said outer layer material are sufficiently compatible such that normal handling and normal use of said tubular structure by said user does not substantially affect one or more of the following: said translucency, said substantially clear drain capability, and further normal function of said tubular structure.

9. The tubular structure according to claim 8, wherein said inner layer material and said outer layer material are different.

10. The tubular structure according to claim 8, wherein said inner layer material is selected from the group consisting of homopolymers or copolymers comprising siloxane groups, homopolymers or copolymers comprising at least partially fluorinated repeat units, and a combination thereof.

11. The tubular structure according to claim 10, wherein said inner layer material comprises a polymer or copolymer consisting essentially of substantially fluorinated repeat units.

12. The tubular structure according to claim 11, wherein said inner layer material comprises fluorinated ethylene-propylene, a perfluoroalkoxy polymer, or both.

13. The tubular structure according to claim 8, wherein the thickness of said inner layer material is at least about 10 microns.

14. The tubular structure according to claim 8, wherein the thickness of said inner layer material is not more than about 3 mm.

15. The tubular structure according to claim 8, wherein said outer layer material is substantially inflexible during use of said tubular structure.

16. The tubular structure according to claim 8, which exhibits an optical light transmittance under ASTM D1003 of at least about 80%.

17. The tubular structure according to claim 8, wherein the difference between the surface tension of the fluid to contact said tubular structure and the surface energy of a fluid-contacting surface of said inner layer material is at least about 5 mN/m.

18. The tubular structure according to claim 8, wherein said outer layer material exhibits one or more of the following: a tensile modulus of at least about 1400 psi; a flexural modulus of at least about $10^5$ psi; a tensile strength of at least about 2000 psi; and a percent elongation of no more than about 100%.

19. A method of making a substantially clear drain tubular structure comprising an inner layer and an outer layer, said method comprising:

selecting an inner layer material comprising a first polymeric material having sufficient anti-wetting properties with respect to a selected fluid such that said first polymeric material exhibits substantially clear drain of the fluid;

selecting an outer layer material comprising a second polymeric material; and forming a multi-layer tubular structure comprising said inner layer and said outer layer;

wherein:

said tubular structure exhibits sufficient translucency to allow a user externally to observe visually the level of the fluid in said tubular structure; and said inner layer material and said outer layer material are sufficiently compatible such that normal handling and normal use of said tubular structure by said user does not substantially affect said transparency, said substantially clear drain capability, and/or further normal function of said tubular structure.

20. The method according to claim 19, wherein said inner layer material comprises a polysiloxane homopolymer or copolymer, a polymer or copolymer having at least partially fluorinated repeat units, or both.

21. The method according to claim 19, further comprising selecting and forming said inner layer material to be substantially inflexible during use of said tubular structure.

22. The method according to claim 19, further comprising co-extruding said inner layer material and said outer layer material.

23. The method according to claim 19, wherein said forming of said multi-layer tubular structure comprises co-extrusion of said inner layer material and said outer layer.

24. The method according to claim 19, further comprising selecting said second polymeric material from the group consisting of homopolymers or copolymers in which at least a portion of the repeat units comprise siloxane groups, at least partially fluorinated repeat units, or a combination thereof.

25. A method of making a substantially clear drain tubular structure, said method comprising co-extruding a multi-layer tubular structure comprising an inner layer material and an outer layer material, wherein:

said inner layer material comprises a polymeric material having sufficient anti-wetting properties with respect to a selected fluid such that said first polymeric material exhibits substantially clear drain of the fluid;

said outer layer material is sufficiently translucent and said inner layer material is sufficiently thin so that, when co-extruded, said tubular structure exhibits sufficient translucency to allow a user externally to observe visually the fluid in said tubular structure; and said inner layer material and said outer layer material are sufficiently compatible such that normal handling and normal use of said tubular structure by said user does not substantially affect one or more of the following: said translucency, said substantially clear drain capability, and further normal function of said tubular structure.

26. The method according to claim 25, wherein said inner layer material is selected from the group consisting of homopolymers or copolymers comprising siloxane groups, homopolymers or copolymers comprising at least partially fluorinated repeat units, and a combination thereof.

27. The method according to claim 26, wherein said inner layer material comprises fluorinated ethylene-propylene, a perfluoroalkoxy polymer, or both.

28. The method according to claim 25, wherein said inner layer material has a thickness of no more than about 3 mm.

29. The method according to claim 25, wherein the difference between the surface tension of the selected fluid and the surface energy of a fluid-contacting surface of said inner layer material is at least about 3 mN/m.

30. A multi-layer tube capable of containing or transporting a liquid therein, said tube comprising:

an inner layer comprising a first polymeric material having sufficient anti-wetting properties with respect to the liquid such that said first polymeric material exhibits substantially clear drain of the liquid, said first polymeric material comprising a polymer or copolymer having at least partially fluorinated repeat units; and an outer layer co-extruded with said inner layer and comprising a second polymeric material;

wherein:

said inner layer material and said outer layer material, together, are sufficiently translucent such that the liquid can be externally visually observed; and said inner layer material and said outer layer material are sufficiently compatible such that normal handling and normal use of said multi-layer tube does not substantially affect said transparency or translucency, said substantially clear drain capability, or further normal function of said multi-layer tube.

31. The multi-layer tube according to claim 30, wherein said inner layer material comprises fluorinated ethylene-propylene and/or a perfluoroalkoxy polymer.

32. The multi-layer tube according to claim 30, wherein the thickness of said inner layer material is at least about 10 microns.

33. The multi-layer tube according to claim 30, wherein the thickness of said inner layer material is not more than about 3 mm.

34. The multi-layer tube according to claim 30, wherein said inner layer material is substantially inflexible during use of said tube.

35. The multi-layer tube according to claim 30, which exhibits an optical light transmittance under ASTM D1003 of at least about 80%.

36. The multi-layer tube according to claim 30, wherein the difference between the surface tension of the liquid and the surface energy of a liquid-contacting surface of said inner layer material is at least about 5 mN/m.

* * * * *